United States Patent [19]

Ono

[11] 4,402,295

[45] Sep. 6, 1983

[54] ELECTRONICALLY CONTROLLED FUEL INJECTION APPARATUS FOR INTERNAL COMBUSTION ENGINE

[75] Inventor: Hironobu Ono, Toyota, Japan

[73] Assignee: Toyota Jidosha Kabushiki Kaisha, Toyota, Japan

[21] Appl. No.: 443,638

[22] Filed: Nov. 22, 1982

Related U.S. Application Data

[63] Continuation-in-part of Ser. No. 249,477, Mar. 31, 1981, abandoned.

[30] Foreign Application Priority Data

Mar. 31, 1980 [JP] Japan ..... 55-41312

[51] Int. Cl.[3] ..... F02D 5/00; F02D 17/00

[52] U.S. Cl. ..... 123/493; 123/492; 123/494

[58] Field of Search ..... 123/493, 492, 494, 325, 123/198 F, 486

[56] References Cited

U.S. PATENT DOCUMENTS

| | | | |
|---|---|---|---|
| 4,144,847 | 3/1979 | Hosaka | 123/493 |
| 4,202,295 | 5/1980 | Kondo et al. | 123/492 |
| 4,204,483 | 5/1980 | Harada et al. | 123/493 |
| 4,240,383 | 12/1980 | Horbolt et al. | 123/492 |
| 4,274,382 | 6/1981 | Sugasawa et al. | 123/493 |
| 4,276,863 | 7/1981 | Sugasawa et al. | 123/493 |
| 4,305,365 | 12/1981 | Iiznka et al. | 123/493 |
| 4,319,327 | 3/1982 | Higashiyama et al. | 123/492 |
| 4,327,682 | 5/1982 | Harada | 123/493 |
| 4,353,342 | 10/1982 | Sugasawa et al. | 123/493 |
| 4,357,924 | 11/1982 | Sugasawa et al. | 123/493 |

*Primary Examiner*—Raymond A. Nelli

*Attorney, Agent, or Firm*—Parkhurst & Oliff

[57] ABSTRACT

An improvement in an electronically controlled fuel injection apparatus which determines the amount of fuel injection and, in a deceleration mode, stop the fuel injection until an engine rotation speed falls below a predetermined fuel injection reinitiation rotation speed if the current engine rotation speed is higher than a predetermined fuel injection stop rotation speed. When an air conditioner compressor is active, the fuel injection stop rotation speed, or the fuel injection stop rotation speed and the fuel injection reinitiation rotation speed, or the fuel injection reinitiation rotation speed are raised. Alternatively, when the air conditioner compressor is active, the fuel injection stop rotation speed, or the fuel injection stop rotation speed and the fuel injection reinitiation speed, or the fuel injection reinitiation rotation speed are raised and the stop of the fuel injection is suppressed when the engine rotation speed is between the raised fuel injection stop rotation speed and the raised fuel injection reinitiation rotation speed. As a result, smooth feeling of deceleration is attained when the air conditioner compressor is active and the drivability is improved.

22 Claims, 6 Drawing Figures

ELECTRONICALLY CONTROLLED FUEL INJECTION APPARATUS FOR INTERNAL COMBUSTION ENGINE

This is a continuation-in-part of the application Ser. No. 249,477 filed Mar. 31, 1981, now abandoned.

BACKGROUND OF THE INVENTION

1. Field of the Invention

The present invention relates to an electronically controlled fuel injection apparatus for an internal cumbustion engine, and more particular to an improvement of an electronically controlled fuel injection apparatus for an internal combustion engine suitable for use in an internal combustion engine of an automobile having an air conditioning device, which apparatus determines the amount of fuel injection in accordance with engine operating conditions such as an engine rotation speed and the amount of intake air and, in a deceleration operation, cuts the fuel injection until the engine rotation speed falls below a predetermined fuel injection reinitiation rotation speed if the current engine rotation speed is higher than a predetermined fuel injection cut rotation speed.

2. Description of the Prior Art

As apparatus for supplying air-fuel mixture having an optimum air-fuel ratio in accordance with operating conditions of an internal combustion engine to a combustion chamber of the engine, apparatus which uses an carburetor and apparatus which uses a mechanically or electronically controlled fuel injection apparatus have been known. In recent years, the electronically controlled fuel injection apparatus has been widely used because it can supply air-fuel mixture having a correct air-fuel ratio to an engine of an automobile which requires purification measures for exhaust gas. In a prior art internal combustion engine having such an electronically controlled fuel injection apparatus, the fuel injection is cut in a deceleration operation until an engine rotation speed falls below a predetermined fuel injection reinitiation rotation speed if the current engine rotation speed is higher than a predetermined fuel injection cut rotation speed in order to prevent after-fire, save fuel and prevent exhaust of incomplete combustion gas. The fuel injection reinitiation rotation speed is set in addition to the fuel injection cut rotation speed in order to provide a hysteresis function to the stop of the fuel injection to prevent undesired condition such as hunting from occurring. In the prior art electronically controlled fuel injection apparatus, however, the fuel injection is stopped even when a compressor of a car air conditioner is driven by an engine output shaft into an active state and the amount of intake air when a throttle valve is fully closed is increased by an air bypass valve of a throttle body in order to maintain necessary output for the compressor of the air conditioner. Accordingly, in the deceleration operation when the air conditioner compressor is active, a torque generated by the engine immediately before the stop of the fuel injection is large and a friction torque immediately after the stop of the fuel injection is large. Since a difference between the positive and negative torques is large, the drivability is very poor and a shock occurs upon the stop of the fuel injection.

In the prior art electronically controlled fuel injection apparatus, the fuel injection is stopped until the engine rotation speed falls below the predetermined fuel injection reinitiation rotation speed if the current engine rotation speed is higher than the predetermined fuel injection cut rotation speed in order to prevent the hunting, as described above. If the engine rotation speed is higher than the predetermined fuel injection cut rotation speed, the operation mode moves to the deceleration mode. If the deceleration mode resumes if it has been interrupted intermediate the fuel injection cut rotation speed and the fuel injection reinitiation rotation speed, the fuel injection is stopped until the engine rotation speed falls below the fuel injection reinitiation rotation speed. Accordingly, the prior art apparatus has problems in the drivability of car when it is accelerated or decelerated during the deceleration mode.

SUMMARY OF THE INVENTION

The present invention is intended to resolve the problems encountered in the prior art apparatus and it is a first object of the present invention to provide an electronically controlled fuel injection apparatus for an internal combustion engine which can provide very smooth feeling of deceleration without shock even in a deceleration mode when a compressor of an air conditioner is working.

In addition to the first object above, it is a second object of the present invention to provide an electronically controlled fuel injection apparatus for an internal combustion engine which can provide super drivability when a car is accelerated or decelerated during the deceleration mode when a compressor of an air conditioner is working.

The first object of the present invention is attained in an electronically controlled fuel injection apparatus for an internal combustion engine which determines the amount of fuel injection in accordance with the operating conditions of the engine such as an engine rotation speed and the amount of intake air and cuts the fuel injection in the deceleration operation until the engine rotation speed falls below a predetermined fuel injection reinitiation rotation speed if the current engine rotation speed is higher than a predetermined fuel injection cut rotation speed, by increasing the fuel injection cut rotation speed, or the fuel injection cut rotation speed and the fuel injection reinitiation rotation speed, or the fuel injection reinitiation rotation speed if the compressor of the air conditioner driven by an engine output shaft is active.

The second object of the present invention is attained in the electronically controlled fuel injection apparatus for the internal combustion engine by increasing the fuel injection cut rotation speed, or the fuel injection cut rotation speed and the fuel injection reinitiation rotation speed, or the fuel injection reinitiation rotation speed if the compressor of the air conditioner driven by the engine output shaft is active and suppressing the cut of the fuel injection even if the deceleration mode is resumed after the interruption if the engine rotation speed is between the increased fuel injection cut rotation speed and the fuel injection reinitiation rotation speed.

BRIEF DESCRIPTION OF THE DRAWINGS

The above and other features and the objects of the present invention will become more apparent by reference to the following description taken in conjunction with the accompanying drawings, wherein like referenced numerals denote like elements, and in which.

DETAILED DESCRIPTION OF THE INVENTION

Figure 1:
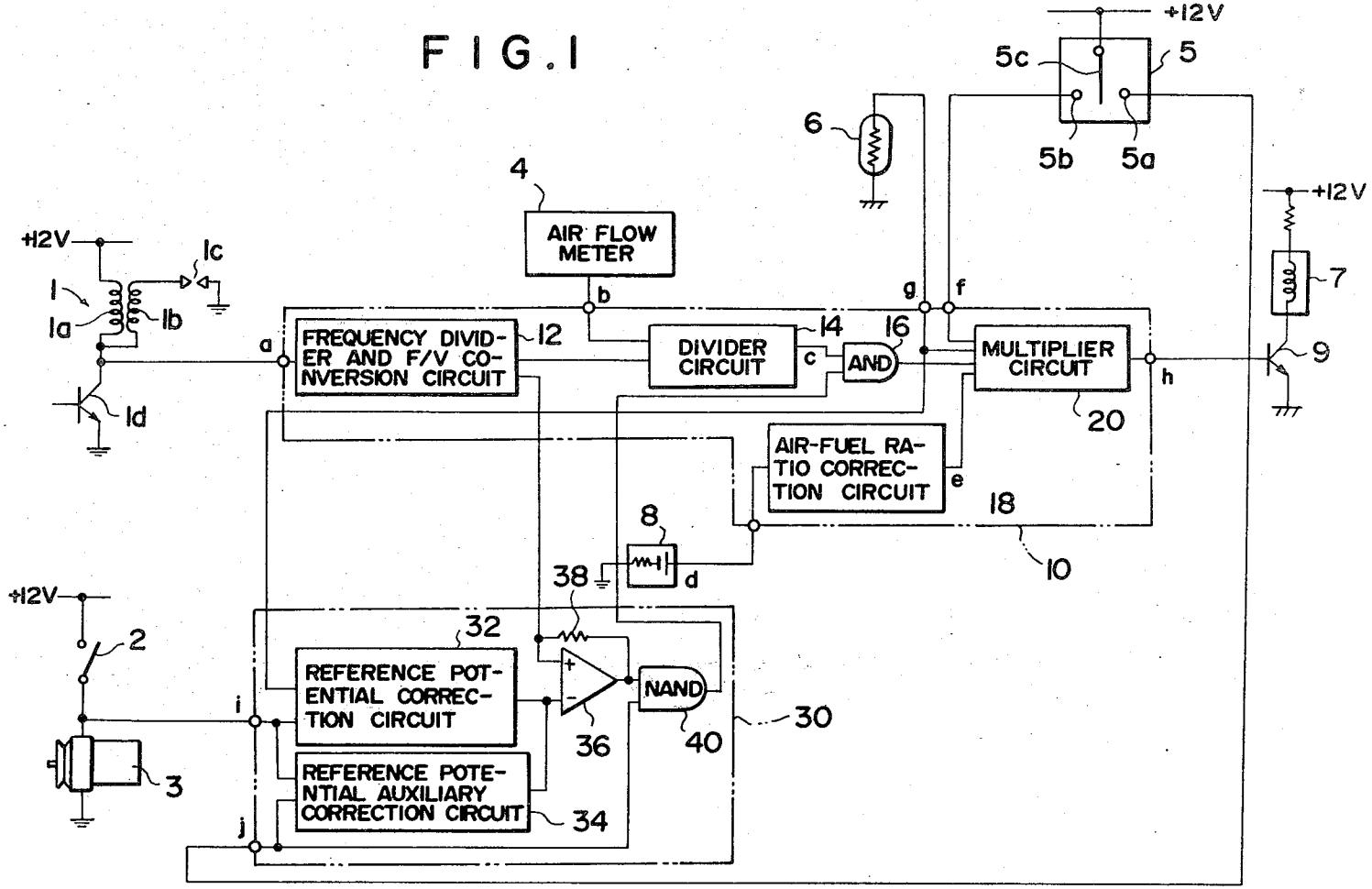
FIG. 1 shows a block diagram of an embodiment of an electronically controlled fuel injection apparatus for an internal combustion engine in accordance with the present invention.

An embodiment of the present invention will now be described in detail with reference to the accompanying drawings. The present embodiment comprises a basic processing circuit 10 and a fuel injection cutting circuit 30. The basic processing circuit 10 includes a frequency divider and F/V conversion circuit 12 to which an engine rotation speed signal a is applied from an ignition circuit 1 comprising a primary coil 1*a*, a secondary coil 1*b*, an ignition plug 1*c* and an igniter 1*d*. An output terminal of the frequency divider and F/V conversion circuit 12 is applied to one of input terminals of a divider circuit 14 and also connected to the fuel injection cutting circuit 30. The other of the input terminals of the divider circuit 14 is applied with an intake airflow signal b from an intake air flow meter 4 to detect an intake air flowrate of the engine. This output terminal of the divider circuit 14 is connected to an AND gate 16, whose output terminal is connected to a multiplier circuit 20.

The multiplier circuit 20 is further applied thereto with an engine coolant temperature signal g from a thermistor 6 to detect an engine coolant temperature and a throttle full-open signal f from a throttle switch 5. More specifically, the throttle switch 5 comprises: an idle contact 5*a*, a full-open contact 5*b* and a probe 5*c*, when the probe 5*c* contacts the full-open contact 5*b*, the throttle full-open signal f is produced, and, when the probe 5*c* contacts the idle contact 5*a*, a throttle full-close signal is produced. An air-fuel ratio signal d produced by the $O_2$ sensor 8 is converted into an air-fuel ratio correction signal e by an air-fuel ratio correction circuit 18, and this air-fuel correction signal is applied to the multiplier circuit 20.

The fuel injection cutting circuit 30 comprises a reference potential correction circuit 32 and a reference potential auxiliary correction circuit 34. One of input terminals of the reference potential correction circuit 32 is applied thereto with the engine coolant temperature signal g, and the other of the input terminals is applied thereto with a cooler compressor activation signal i, which is produced from an air conditioner switch 2 provided on a magnetic clutch of a cooler compressor 3. An output terminal of this reference potential correction circuit 32 is connected to a negative input terminal of an engine rotational speed comparator 36.

The reference potential auxiliary correction circuit 34 is applied thereto with the cooler compressor active signal i and a throttle full-close signal j. An output terminal of the reference potential auxiliary correction circuit 34 is connected to a negative input terminal of the engine rotational speed comparator 36.

A positive input terminal of the engine rotational speed comparator 36 is connected thereto with an output terminal of the frequency divider and F/V convertion circuit 12. An output terminal of the engine rotational speed comparator 36 is connected to one of input terminals of a NAND gate 40 and connected to a positive input terminal of the comparator 36 through a resistor 38. This resistor 38 provides a hysteresis characteristics to the comparator 36.

The other of the input terminals of the NAND gate 40 is connected thereto with a throttle switch 5 so that the throttle valve full-close signal j can be applied, and an output terminal of the NAND gate 40 is connected to the other of the input terminals of the AND gate 16.

A block diagram of the circuit shown in FIG. 1 will now be described in detail with reference to FIGS. 2 and 3. The frequency divider and F/V conversion circuit 12 includes a monostable multivibrator 121 whose input terminal is connected to the ignition circuit 1. An output terminal of the monostable multivibrator 121 is connected to a clock terminal of a JK-flip-flop (JK-FF) 122, and connected to an integrator comprising a resistor 123, a capacitor 124 and an operational amplifier 125. A Q terminal of the JK-FF 122 is connected to the divider circuit 14, and an output terminal of integrator is connected to the positive input terminal of the engine rotational speed comparator 36.

The divider circuit 14 comprises: and AND gate 141, one of input terminals of which is connected to the Q terminal of the JK-FF 122; and a first analogue switch 142 connected to the Q terminal of the JK-FF 122. An end of the first analogue switch 142 is connected to a power source through a V/I converter 143 to convert voltage into current. The other end of the first analogue switch 142 is grounded through a capacitor 144 to determine the time period, for which current is supplied to the injector, connected to a positive input terminal of the comparator 146 through a resistor 145, and connected to an end of a second analogue switch 147. The other end of the second analogue switch 147 is connected to an air flow meter 4 through an V/I converter 148. An output terminal of the comparator 146 is connected to the other of the input terminals of the AND gate 141. An output terminal of the AND gate 141 is connected to the second analogue switch 147 and also connected to the multiplier circuit 20 through the AND gate 16.

The air-fuel ratio correction circuit 18 is a series circuit comprising a voltage follower consisting of an operational amplifier 181, resistor 185, comparator 186, and an integrator circuit including a resistor 182, a capacitor 183 and an operational amplifier 184. An output terminal of this integrator circuit is connected to the multiplier circuit 20.

The multiplier circuit 20 having an arrangement substantially similar to the divider circuit 14, includes: an AND gate 201; analogue switches 202 and 207; V/I converters 203 and 208; a capacitor 204; a resistor 205; and a comparator 206. The V/I converter 208 is connected to the full-open terminal 5*b* of the throttle switch 5 through a resistor 209 and a signal conversion circuit 212 for extending the discharging time of the capacitor 204 to thereby extend the fuel injection time, connected to the thermistor 6 through a resistor 210 and a signal conversion circuit 213 similar to the above, and further connected to the air-fuel ratio correction circuit 18 through a resistor 211 and a signal conversion circuit 214 similar to the above.

The reference potential correction circuit 32 includes a first comparator 321 and a second comparator 322. A positive input terminal of the first comparator 321 is connected to the other end of the thermistor 6, one end of which is grounded, and connected to a power source (for example, 12 V) through a resistor $R_1$. A negative input terminal of the first comparator 321 is connected to a power source through a resistor $R_2$, and grounded through a resistor $R_3$. These resistors $R_2$ and $R_3$ constitute a potential divider circuit and apply a reference voltage corresponding to a reference temperature $T_0$ to a negative input terminal of the first comparator 321. An output terminal of the first comparator 321 is connected to a positive input terminal of the second comparator 322 through a diode $D_1$ and a resistor $R_4$.

One end of a resistor $R_4$ connected to the second comparator 322 is connected to the air conditioner switch 2, and grounded through a resistor $R_6$, a capacitor $C_1$ and a diode $D_2$. Furthermore, one end of the resistor $R_4$ connected to the second comparator 322 is connected to one of input terminals of an AND gate 341 constituting the reference potential auxiliary correction circuit 34. Additionally, a negative input terminal of the second comparator 322 is connected to the power source through a resistor $R_7$, and grounded through a resistor $R_8$. An output terminal of the second comparator 322 is connected to a negative input terminal of the comparator 36 through a resistor $R_9$ and a diode $D_4$.

The other end of the thermistor 6 is connected to a base of a transistor $T_r$. A collector of this transistor $T_r$ is connected to the power source, emitter thereof is grounded through a resistor $R_{10}$, and further connected to a negative input terminal of the comparator 36.

A positive input terminal of the comparator 36 is connected to an output terminal of the comparator 36 through the resistor 38 to provide the hysteresis characteristics to the comparator 36. A negative input terminal of the comparator 36 is connected to the power source through a resistor $R_{11}$ and grounded through a resistor $R_{12}$. The output terminal of the comparator 36 is connected to one of input terminals of the NAND gate 40.

The reference potential auxiliary correction circuit 34 includes an AND gate 341 and an inverter 342. An input terminal of the inverter 342 is connected to the idle contact **5*a* of the throttle switch 5, and an output terminal of the inverter 342 is connected to the other of the input terminal of the AND gate 341. An output terminal of the AND gate 341 is connected to negative input terminal of the comparator 36** through a resistor $R_{13}$ and a diode $D_5$.

The operation of the present embodiment will now be explained. Since the thermistor 6 has such a characteristics that, when the temperature rises, the resistance is lowered in value, whereby the level of the engine coolant temperature signal g is lowered with the rise in the temperature.

Figure 2:
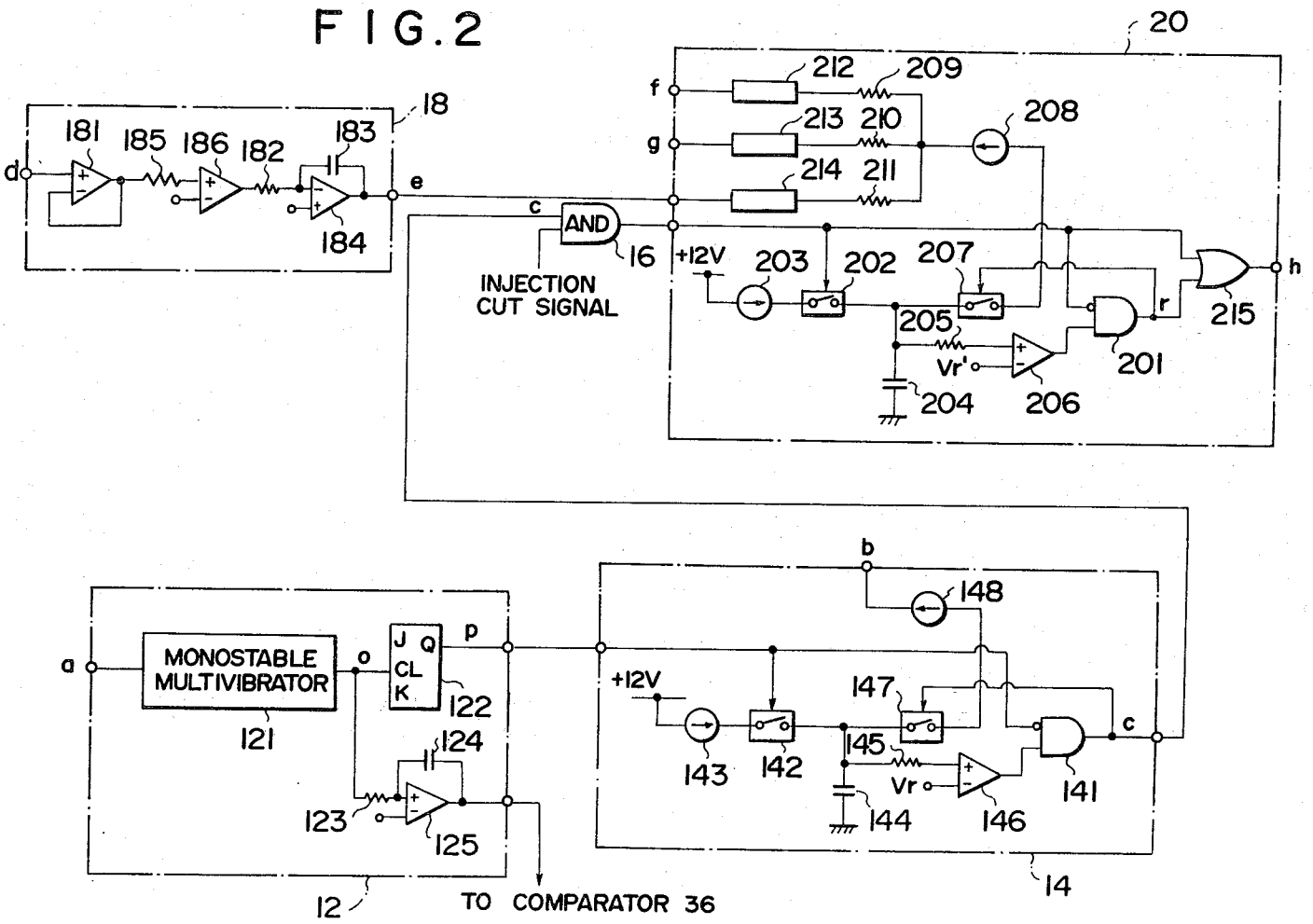
FIGS. 2 and 3 show detailed circuit diagrams of FIG. 1.
Figure 3:
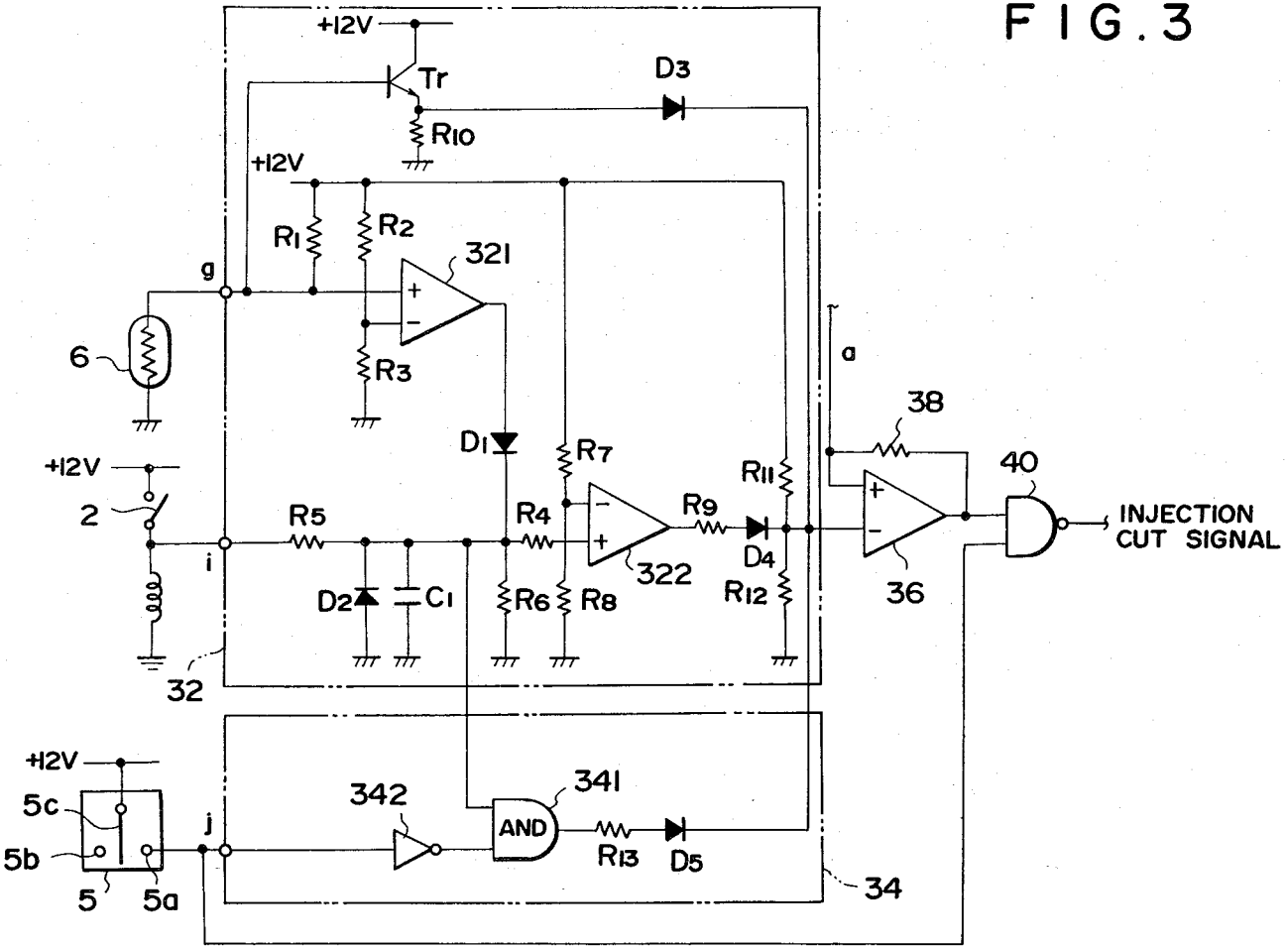

Firstly, as shown in FIG. 2, description will be given of the condition where the air conditioner switch 2 is "OFF" and the probe **5*c* of the throttle switch 5 is not in contact with the idle contact 5*a*. The engine coolant temperature signal g is applied to the first comparator 321 and the transistor $T_r$. In the first comparator 321, the level of the engine coolant temperature signal g is compared with a reference voltage corresponding to the reference temperature $T_0$, and, when the level of the engine coolant temperature signal g exceeds the reference voltage in value, a high level signal is produced and, when the level of the engine coolant temperature signal g is lower than the reference voltage, a low level signal is produced. In other words, the first comparator 321** produces the high level signal when the coolant temperature is lower than the reference temperature $T_0$, and produces the low level signal when the coolant temperature is higher than the reference temperature $T_0$.

When the low level signal is produced from the first comparator 321, a low level signal is produced from the second comparator 322 as well. Since the engine coolant temperature signal g is applied to the base of the transistor $T_r$, when the level of the engine coolant temperature signal g rises, the value of resistance of the transistor $T_r$ is decreased, and consequently, an emitter potential rises. In other words, when the engine coolant temperature rises, the emitter potential is lowered and, when the engine coolant temperature is lowered, and emitter potential rises. This emitter potential together with a voltage from a potential divider circuit constituted by the resistors $R_{11}$ and $R_{12}$ are applied to a negative terminal of the comparator 36, thus becoming a reference voltage of the comparator 36. As a result, the reference voltage of the comparator 36 is decreased with the rise of engine coolant temperature.

When the high level signal is being produced from the first comparator 321, a voltage at a positive input terminal of the second comparator 322 exceeds a reference voltage potential-divider by resistors $R_7$ and $R_8$, and hence, a high level signal is produced by the second comparator 322, and the reference voltage of the comparator 36 becomes higher by a predetermined value than the above-described case (the case where the low level signal is produced by the first comparator 321).

When the air conditioner switch 2 is "ON", a cooler compressor activation signal i of a high level is applied to a positive input terminal of the second comparator 322, whereby a high level signal is produced from the second comparator 322. As a result, the reference voltage of the comparator 36 becomes higher by a predetermined value than the above-described case in the same manner as in the case where the signal of the high level is produced by the first comparator 321.

On the other hand, the cooler compressor activation signal i is applied to one of input terminals of the AND gate 341 through the resistor $R_5$. In this condition, when the throttle switch 5 is "OFF", a high level signal is applied to the other of the input terminal of the AND gate 341, whereby a high level signal is produced from the AND gate 341 and applied to a negative input terminal of the comparator 36 through the resistor $R_{13}$ and the diode $D_5$. As a result, the reference voltage of the comparator 36 becomes higher than in the case where the high level signal is produced by the first comparator. In contrast to the above, when the probe **5*c* is in contact with the idle contact 5*a* and the throttle switch 5 is "ON", i.e., the throttle valve has a minimum open degree, a low level signal is applied to the AND gate 341 through the inverter 342, whereby a low level signal is produced from the AND gate 341 and the reference voltage of the comparator 36 becomes the same as in the case where the high level signal is produced by the first comparator 321**.

To put together the above descriptions, the reference voltages of the comparator 36 will become as follows. In this case, $V_0 < V_1 < V_2$.

(1) Reference voltage $V_0$

Irrespective of the condition of the throttle switch 5, the coolant temperature $>T_0$ and the cooler compressor in non-operation.

(2) Reference voltage $V_1$

Irrespective of the condition of the throttle opening switch 5, the coolant temperature $\leqq T_0$ and the cooler compressor in non-operation, or irrespective of the value of the coolant temperature, the cooler compressor in non-operation and the throttle valve opening at the minimum.

(3) Reference voltage $V_2$

Irrespective of the value of the coolant temperature, the throttle valve aperture not at the minimum and the cooler compressor in operation.

Here, since the comparator 36 is provided with the hysteresis function by the resistor 38, an upper trip point and a lower trip point of the hysteresis characteristics is varied in accordance with the value of the reference voltages (1) through (3) as described above.

The comparator 36 compares the trip points of the hysteresis characteristics provided by the reference voltage and the resistor 38 with the level of an engine rotational speed signal a, when the level of the engine rotational speed signal a crosses the upper trip point from below to above, produces a high level signal, and, when the level of the engine rotational speed signal a crosses the lower trip point from above to below, produces a low level signal. Additionally, when the level of the engine rotational speed signal a is present between the upper trip point and the lower trip point, the level depends on the preceding condition, and hence, it is uncertain whether a high level signal or a low level signal is produced.

The signal produced by the comparator 36 is applied to one of input terminals of the NAND gate 40. On the other hand, since the other of the input terminals of the NAND gate 40 is applied thereto with the throttle full-close signal, a low level signal is emitted from the NAND gate 40 when an output from the comparator 36 is on the high level and the throttle valve is at the minimum. This low level signal acts as a fuel injection cut signal.

Figure 4:
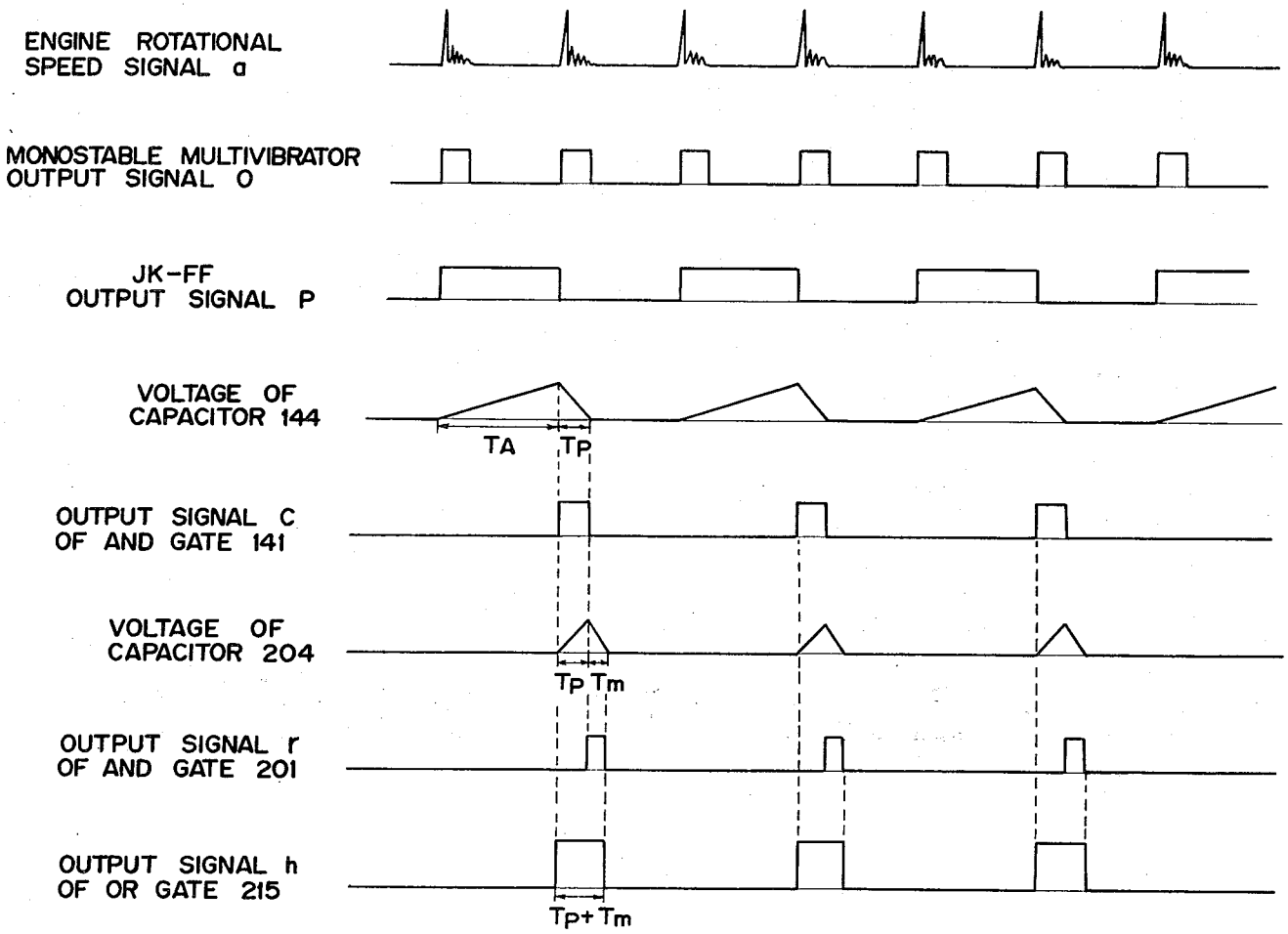
FIG. 4 shows a timing chart of signals produced from respective circuits of FIG. 2.

The engine rotational speed signal a has a waveform shown in FIG. 4, is wave-shaped by the monostable multivibrator 121 and turned into an output signal O shown in FIG. 4. The output signal O from the monostable multivibrator 121 is frequency-divided by the JK-FF 122 and produced as a signal P shown in FIG. 4, integrated by an integration circuit, and compared with the hysteresis characteristics in the comparator 36 as aforesaid.

The analogue switch 142 of the divider circuit 14 is turned "ON" when the output signal P from the JK-FF is on the high level, and is turned "OFF" when the output signal P is on the low level. When the analogue switch 142 is turned "ON", current flows from the power source to the capacitor 144 through a V/I converter 143 and the analogue switch 142, whereby the capacitor 144 is charged and the voltage in the capacitor 144 is increased as shown in FIG. 4. When the capacitor 144 is charged and the charged voltage exceeds the reference voltage $V_r$ of the comparator 146, a high level signal is produced by the comparator 146. When the capacitor 144 is charged for a period of time $T_A$ and the output signal P from the JK-FF is turned into a low level signal, a high level signal is produced by the AND gate 141 and the second analogue switch 147 is turned "OFF". When the analogue switch 147 is turned "ON", an electric charge, which has been charged in the capacitor 144 is discharged through the analogue switch 147 and the V/I converter 148. Since the intake air flowrate signal b having a voltage proportional to an intake air flowrate is applied to the V/I converter 148 from the air flow meter 4 at this time, if the level of the intake air flowrate signal b is large, a discharging time $T_P$ becomes longer. In contrast thereto, when the level of the intake air flowrate signal b is small, the discharging time $T_P$ becomes shorter.

In consequence, when the output signal P is on the low level, a pulse signal c having a pulse width of $T_P$ shown in FIG. 4 is produced by the AND gate 141. The pulse width $T_P$ of the pulse signal c represents a basic fuel injection flowrate, and is proportional to Q/N where the intake air flowrate is Q and the engine rotational speed is N.

This pulse signal c is applied to one of input terminals of the AND gate 16, and, when the output from the NAND gate 40 is on the high level, i.e., no injection cut signal (a low level signal) is produced by the NAND gate 40, applied to the multiplier circuit 20.

In the multiplier circuit 20, in the same manner as in the divider circuit 14, when the pulse signal c is on the high level, the analogue switch 202 is turned "ON" to charge the capacitor 204, and, when the pulse signal c is turned into the low level, the capacitor 204 is discharged for the period of time $T_m$. During this discharging time $T_m$, an output signal r shown in FIG. 4 is produced by the AND gate 201. This output signal r is a pulse signal having a pulse width $T_m$. This pulse width $T_m$ is enlarged in proportion to the magnitudes of the level of the engine coolant temperature signal g and the air-fuel ratio correction signal e. In consequence, an increasing correction is rendered to the basic fuel injection flowrate in the acceleration operation, during which the throttle valve is maximum open, when the engine coolant temperature is low, or the air fuel ratio is lean.

Since the output signal c from the AND gate 141 and the output signal r from the AND gate 201 are applied to the OR gate 215, a pulse signal h having a pulse width $T_p+T_m$ shown in FIG. 4 is produced and the igniter is controlled by this pulse width.

On the other hand, when the fuel injection cut signal of the low level is produced by the NAND gate 40, the output from the AND gate 16 is turned into the low level, whereby the fuel injection is cut.

The reference potential in the engine rotation speed comparator 36 when the air conditioner compressor activation signal i is not applied is set such that the fuel injection cut rotation speed is 1600 RPM and the fuel injection reinitiation rotation speed is 1200 RPM, and the reference potential when the air conditioner compressor activation signal i is applied is set such that the fuel injection cut rotation speed is 2000 RPM and the fuel injection reinitiation rotation speed is 1600 RPM.

The engine coolant temperature signal g and the air conditioner compressor activation signal i are applied to the respective input terminals of the reference potential correction circuit 32 connected to the engine rotation speed comparator 36. When the coolant temperature is low or the air conditioner compressor is active, the reference potential correction circuit 32 raises the reference potential so that the engine rotation speed which causes the output of the engine rotation speed comparator 36 to assume "1" level is switched to the higher value. On the other hand, the engine rotation speed signal a is applied to the positive input terminal of the engine rotation speed comparator 36 via the frequency divider and F/V conversion circuit 12. The output of the engine rotation speed comparator 36 together with the throttle full-close signal j are applied to the NAND gate 40, which causes the output of the AND gate 16 connected to the NAND gate 40 to assume "0" level when the throttle valve is fully closed and the engine rotation speed is higher than the preset value so that the application of the basic injection signal c to the multiplier circuit 20 is inhibited and the issuance of the fuel injection signal h from the multiplier circuit 20 is inhibited. When the air conditioner compressor activation signal i is applied to the fuel injection cutting circuit 30 and the throttle full-close signal j is not applied thereto, that is, when the car is not in the deceleration mode, the fuel injection stop circuit 30 raises the reference potential of the engine rotation speed comparator 36 to a very high level through the function of the reference potential auxiliary correction circuit 34 so that even if the engine rotation speed had been so high in the previous state and the throttle valve is fully closed that the engine rotation speed comparator 36 produces "1" level which is within the hysteresis created by the resistor 38, the raised reference potential forcedly cancel the hysteresis to cause the output of the comparator 36 to assume "0" level. As a result, even if the throttle full-close signal j is again applied during the period of hysteresis, the fuel injection is not cut under this condition.

In the present embodiment, not only the fuel injection cut rotation speed and the fuel injection reinitiation rotation speed are raised by the air conditioner compressor active signal i but also in the intermediate hysteresis range the fuel injection is stopped only when the throttle full-close signal j is applied continuously. Accordingly, the fuel injection is not cut upon the acceleration and the deceleration in the hysteresis region so that the drivability of the car is improved.

Figure 5:
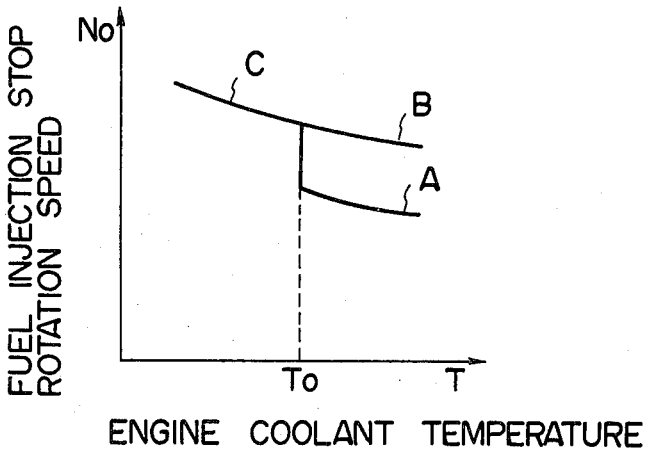
FIG. 5 shows a chart illustrating a relationship between an engine coolant temperature and a fuel injection cut rotation speed in the embodiment of the present invention.

FIG. 5 shows a relationship between the engine coolant temperature T and the fuel injection cut rotation speed $N_0$. As seen from the chart, when the engine coolant temperature is higher than a predetermined temperature $T_0$, the fuel injection cut rotation speed when the air conditioner compressor is not active is given by a solid line A while the fuel injection cut rotation speed when the air conditioner compressor is active is raised as shown by a solid line B. On the other hand, when the engine coolant temperature is lower than the predetermined temperature $T_0$, the fuel injecton cut rotation speed follows a relatively high level curve (curve C) independently of the active or non-active state of the air conditioner compressor.

Figure 6:
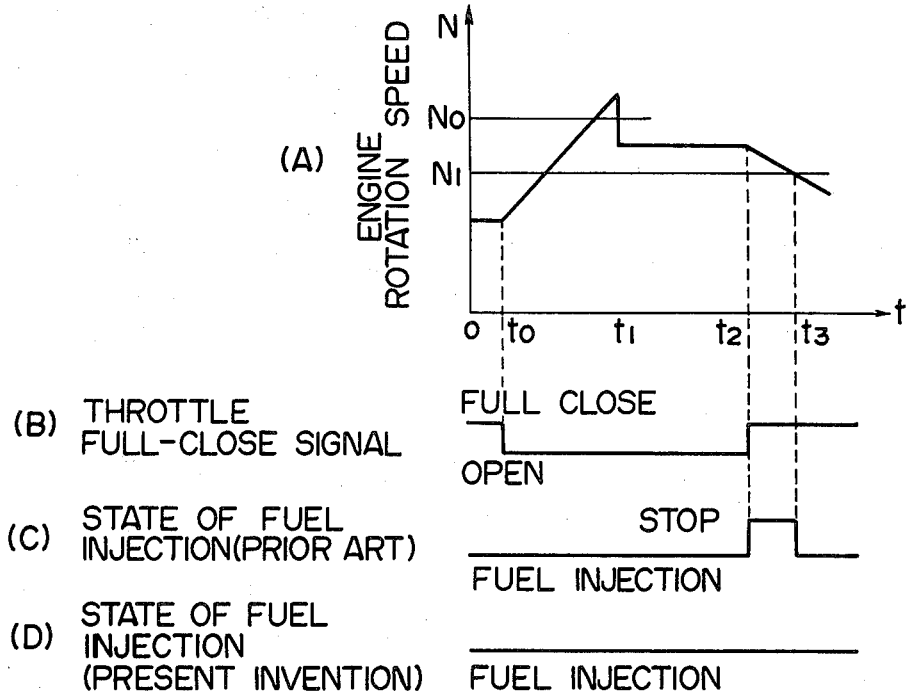
FIG. 6 shows a comparative chart for relations between a change in time of the engine rotation speed and a fuel injection cut condition for the embodiment of the present invention and a prior art system, respectively.

FIG. 6 shows an example of change of the engine rotation speed N with respect to time t. Referring to FIG. 6(A), it is assumed that the car is accelerated from time $t_0$ by a low gear ratio, and when the engine rotation speed exceeds the fuel injecion cut rotation speed $N_0$, the gear ratio is switched to a higher one at time $t_1$ and the car then runs at a constant speed. Assuming that the car is decelerated from time $t_2$, in the prior art system, the logical AND function with the throttle full-close signal j (FIG. 6(B)) is met even when the air conditioner compressor is active because the fuel injection reinitiation rotation speed $N_1$ has not been reached. As a result, as shown in FIG. 6(C), the fuel injection is cut during the time period $t_2 \sim t_3$ and deceleration shock is created. On the other hand, in the present invention, since the engine rotation speed N at the time $t_2$ when the throttle full-close signal j is applied does not reach the fuel injection cut rotation speed $N_0$, the fuel injection is not cut in this deceleration mode as shown in FIG. 6(D) and smooth feeling of deceleration is provided.

In the above embodiment, when the air conditioner compressor is active, not only the fuel injection cut roation speed and the fuel injection reinitiation rotation speed are raised but also the cut of the fuel injection is prevented when the engine rotation speed is between the raised fuel injection cut rotation speed and the raised fuel injection reinitiation rotation speed even if the deceleration mode is resumed after it has been interrupted. Accordingly, the drivability upon the acceleration and the deceleration in the deceleration mode is super. It should be understood that the desired advantage can be equally achieved when the fuel injection cut rotation speed and the fuel injection reinitiation rotation speed, or only the fuel injection cut rotation speed are raised when the air conditioner compressor is active.

As explained hereinabove, in accordance with the present invention, very smooth feeling of deceleration is attained in the deceleration mode when the air conditioner compressor driver by the engine output shaft is active and the drivability is improved in the acceleration and the deceleration during the deceleration mode when the air conditioner compressor is active.

From the foregoing description, it should be apparent to those skilled in the art that the above-described embodiment is but one of many possible specific embodiments which can represent the applications of the principles of the present invention. Numerous and varied other arrangements can be readily devised by those skilled in the art without departing from the spirit and scope of the invention.

What is claimed is:

1. An electronically controlled fuel injection apparatus for an internal combustion engine which controls the amount of fuel supplied to said internal combustion engine by controlling an injector, comprising:

engine rotational speed detecting means for detecting a rotational speed of said engine to produce an engine rotational speed signal;

throttle aperture detecting means for detecting an open degree of a throttle valve to produce a throttle aperture signal;

air conditioner compressor activation detecting means for producing an air conditioner compressor activation signal when an air conditioner is activated;

engine rotational speed comparing means having a hysteresis characteristic for producing high engine rotational speed signal when a level of said engine rotational speed signal exceeds a reference value of said hysteresis characteristic and producing a low engine rotational speed signal when the level of said engine rotational speed signal is below said reference value of said hysteresis characteristic;

correction means for raising said reference value when said air conditioner compressor activation signal is produced;

fuel injection cut means for producing a fuel injection cut signal when a minimum open degree of said throttle value is detected by said throttle aperture signal and said high engine rotational speed signal is produced; and calculation means for calculating the amount of basic fuel injection based on said engine rotational speed signal and correcting said amount of basic fuel injection in accordance with an operation condition to produce a fuel injection signal for controlling said injector and inhibiting said fuel injection signal when said fuel injection cut signal is produced.

2. An electronically controlled fuel injection apparatus for an internal combustion engine which controls the amount of fuel supplied to said internal combustion engine by controlling an injector, comprising:

engine rotational speed detecting means for detecting a rotational speed of said engine to produce an engine rotational speed signal;

throttle aperture detecting means for detecting an open degree of a throttle valve to produce a throttle aperture signal;

air conditioner compressor activation detecting means for producing an air conditioner compressor activation signal when an air conditioner is activated;

engine rotational speed comparing means having a hysteresis characteristic for producing high engine rotational speed signal when a level of said engine rotational speed signal exceeds an upper trip point of said hysteresis characteristic and producing a low engine rotational speed signal when the level of said engine rotational speed signal is below a lower trip point of said hysteresis characteristic;

correction means for raising said upper trip point when said air conditioner compressor activation signal is produced;

fuel injection cut means for producing a fuel injection cut signal when a minimum open degree of said throttle valve is detected by said throttle aperture signal and said high engine rotational speed signal is produced; and calculation means for calculating the amount of basic fuel injection based on said engine rotational speed signal and correcting said amount of basic fuel injection in accordance with an operation condition to produce a fuel injection signal for controlling said injector and inhibiting said fuel injection signal when said fuel injection cut signal is produced.

3. An electronically controlled fuel injection apparatus for an internal combustion engine which controls the amount of fuel supplied to said internal combustion engine by controlling an injection, comprising:

engine rotational speed detecting means for detecting a rotational speed of said engine to produce an engine rotational speed signal;

throttle aperture detecting means for detecting an open degree of a throttle valve to produce a throttle aperture signal;

air conditioner compressor activation detecting means for producing an air conditioner compressor activation signal when an air conditioner is activated;

engine rotational speed comparing means having a hysteresis characteristic for producing a high engine rotational speed signal when a level of said engine rotational speed signal exceeds an upper trip point of said hysteresis characteristic and producing a low engine rotational speed signal when the level of said engine rotational speed signal is below a lower trip point of said hysteresis characteristic;

correction auxiliary means for raising said lower trip point when non-minimum open degree of said throttle valve is detected by said throttle aperture signal and said air conditioner compressor activation signal is produced;

fuel injection cut means for producing a fuel injection cut signal when a minimum open degree of said throttle valve is detected by said throttle aperture signal and said high engine rotational speed signal is produced; and calculation means for calculating the amount of basic fuel injection based on said engine rotational speed signal and correcting said amount of basic fuel injection in accordance with an operation condition to produce a fuel injection signal for controlling said injector and inhibiting said fuel injection signal when said fuel injection cut signal is produced.

4. An electronically controlled fuel injection apparatus for an internal combustion engine according to claim 2, further comprising correction auxiliary means for raising said lower trip point when non-minimum open degree of said throttle valve is detected by said throttle aperture signal and said air conditioner compressor activation signal is produced.

5. An electronically controlled fuel injection apparatus for an internal combustion engine which controls the amount of fuel supplied to said internal combustion engine by controlling an injector, comprising:

engine rotational speed detecting means for detecting a rotational speed of said engine to produce an engine rotational speed signal;

intake air amount detecting means for detecting the amount of air supplied to said engine to produce an intake air amount signal;

throttle aperture detecting means for detecting an open degree of a throttle valve to produce a throttle aperture signal;

air conditioner compressor activation detecting means for producing an air conditioner compressor activation signal when an air conditioner is activated;

engine rotational speed comparing means having a hysteresis characteristic for producing a high engine rotational speed signal when a level of said engine rotational speed signal exceeds an upper trip point of said hysteresis characteristic and producing a low engine rotational speed signal when the level of said engine rotational speed signal is below a lower trip point of said hysteresis characteristic;

correction means for raising said upper trip point when said air conditioner compressor activation signal is produced;

correction auxiliary means for raising said lower trip point when a non-minimum open degree of said throttle valve is detected by said throttle aperture signal and said air conditioner compressor activation signal is produced;

fuel injection cut means for producing a fuel injection cut signal when a minimum open degree of said throttle valve is detected by said throttle aperture signal and said high engine rotational speed signal is produced; and calculation means for calculating the amount of basic fuel injection based on said engine rotational speed signal and said intake air amount signal and correcting said amount of basic fuel injection in accordance with an operation condition to produce a fuel injection signal for controlling said injector and inhibiting said fuel injection signal when said fuel injection cut signal is produced.

6. An electronically controlled fuel injection apparatus for an internal combustion engine according to claim 2, further comprising temperature detecting means for detecting a temperature of coolant of said engine to produce a coolant temperature signal, wherein said correction means raises said upper trip point when said air conditioner compressor activation signal is produced, or said coolant temperature signal from said temperature detecting means indicates that the temperature of said coolant is below a predetermined temperature.

7. An electronically controlled fuel injection apparatus for an internal combustion engine according to claim 3, further comprising temperature detecting means for detecting a temperature of coolant of said engine to produce a coolant temperature signal, wherein said correction means raises said upper trip point when said air conditioner compressor activation signal is produced, or said coolant temperature signal from said temperature detecting means indicates that the temperature of said coolant is below a predetermined temperature.

8. An electronically controlled fuel injection apparatus for an internal combustion engine according to claim 4, further comprising temperature detecting means for detecting a temperature of coolant of said engine to produce a coolant temperature signal, wherein said correction means raises said upper trip point when said air conditioner compressor activation signal is produced, or said coolant temperature signal from said temperature detecting means indicates that the temperature of said coolant is below a predetermined temperature.

9. An electronically controlled fuel injection apparatus for an internal combustion engine according to claim 5, further comprising temperature detecting means for detecting a temperature of coolant of said engine to produce a coolant temperature signal, wherein said correction means raises said upper trip point when said air conditioner compressor activation signal is produced, or said coolant temperature signal from said temperature detecting means indicates that the temperature of said coolant is below a predetermined temperature.

10. An electronically controlled fuel injection apparatus for an internal combustion engine according to claim 2, further comprising:

temperature detecting means for detecting a temperature of coolant of said engine to produce a coolant temperature signal; and air-fuel ratio detecting means for detecting a concentration of residual oxygen in exhaust gas to produce an air-fuel ratio signal.

11. An electronically controlled fuel injection apparatus for an internal combustion engine according to claim 3, further comprising:

temperature detecting means for detecting a temperature of coolant of said engine to produce a coolant temperature signal; and air-fuel ratio detecting means for detecting a concentration of residual oxygen in exhaust gas to produce an air-fuel ratio signal.

12. An electronically controlled fuel injection apparatus for an internal combustion engine according to claim 4, further comprising:

temperature detecting means for detecting a temperature of coolant of said engine to produce a coolant temperature signal; and air-fuel ratio detecting means for detecting a concentration of residual oxygen in exhaust gas to produce an air-fuel ratio signal.

13. An electronically controlled fuel injection apparatus for an internal combustion engine according to claim 5, further comprising:

temperature detecting means for detecting a temperature of coolant of said engine to produce a coolant temperature signal; and air-fuel ratio detecting means for detecting a concentration of residual oxygen in exhaust gas to produce an air-fuel ratio signal.

14. An electronically controlled fuel injection apparatus for an internal combustion engine according to claim 10, wherein said correction means raises said upper trip point when said air conditioner compressor signal is produced, or said coolant temperature signal indicates that the temperature of said coolant is below a predetermined temperature, and said calculation means corrects said amount of basic fuel injection by signals including said throttle aperture signal, said coolant temperature signal and said air-fuel ratio signal.

15. An electronically controlled fuel injection apparatus for an internal combustion engine according to claim 11, wherein said correction means raises said upper trip point when said air conditioner compressor signal is produced, or said coolant temperature signal indicates that the temperature of said coolant is below a predetermined temperature, and said calculation means corrects said amount of basic fuel injection by signals including said throttle aperture signal, said coolant temperature signal and said air-furl ratio signal.

16. An electronically controlled fuel injection apparatus for an internal combustion engine according to claim 12, wherein said correction means raises said upper trip point when said air conditioner compressor signal is produced, or said coolant temperature signal indicates that the temperature of said coolant is below a predetermined temperature, and said calculation means corrects said amount of basic fuel injection by signals including said throttle aperture signal, said coolant temperature signal and said air-fuel ratio signal.

17. An electronically controlled fuel injecton apparatus for an internal combustion engine according to claim 13, wherein said correction means raises said upper trip point when said air conditioner compressor signal is produced, or said coolant temperature signal indicates that the temperature of said coolant is below a predetermined temperature, and said calculation means corrects said amount of basic fuel injection by signals including said throttle aperture signal, said coolant temperature signal and said air-fuel ratio signal.

18. An electronically controlled fuel injection apparatus for an internal combustion engine which controls the amount of fuel supplied to said internal combustion engine by controlling an injector, comprising:

an engine rotational speed sensor for detecting a rotational speed of said engine to produce an engine rotational speed signal;

an intake air amount sensor for detecting the amount of air supplied to said engine to produce an intake air amount signal;

a throttle aperture sensor for detecting an open degree of a throttle valve and produce a throttle full-close signal when the open degree of said throttle valve is minimum;

an air conditioner compressor activation sensor for producing an air conditioner compressor activation signal when an air conditioner is activated;

a temperature sensor for detecting a temperature of coolant of said engine to produce a coolant temperature signal;

a converter for converting a frequency of said engine rotational speed signal to a voltage to produce a voltage signal;

a comparator having a hysteresis characteristic imparted by a resistor connected between a positive input terminal thereof and an output terminal thereof, for producing a first signal when said voltage signal is applied to said positive input terminal and a reference voltage is applied to negative input terminal and a level of said voltage signal crosses an upper trip point of said hysteresis characteristic upwardly, and producing a second signal when the level of said voltage signal crosses a lower trip point of said hysteresis characteristic downwardly;

a correction circuit for causing said reference voltage applied to said comparator to assume a first level higher than said reference level when said air conditioner compressor activation signal is produced, or the level of said coolant temperature signal is below a predetermined level;

a correction auxiliary circuit for causing said reference voltage applied to said comparator to assume a second level higher than said first level when said throttle full-close signal is produced and said air conditioner compressor activation signal is produced;

a first gate circuit having one input terminal thereof connected to said output terminal of said comparator and the other input terminal thereof connected to said throttle aperture sensor, for producing fuel injection cut signal when the output of said comparator produces said first signal and said throttle full-close signal is produced;

a divider for dividing the amount of intake air based on said intake air amount signal by an engine rotational speed based on said engine rotational speed signal to determine the amount of basic fuel injection to produce a basic fuel injection signal;

a second gate circuit for passing said basic fuel injection signal when said fuel injection cut signal is not applied thereto and blocking said basic fuel injection signal when said fuel injection cut signal is applied thereto;

an air-fuel ratio sensor for detecting a concentration of residual oxygen in exhaust gas to produce an air-fuel ratio signal; and a multiplier for correcting said basic fuel injection signal basic on signals including said coolant temperature signal and said air-fuel ratio signal to control said injector.

19. An electronically controlled fuel injection apparatus for an internal combustion engine according for an internal combustion engine according to claim 18, wherein said throttle full-close signal, said air conditioner compressor activation signal and said first signal are high level signals, said second signal and said fuel injection stop signal are low level signals, said first gate circuit is a NAND gate and said second gate circuit is an AND gate.

20. An electronically controlled fuel injection apparatus for an internal combustion engine according to claim 18, wherein said first level of said correction circuit is of such a magnitude that said upper trip point exceeds the level of said voltage signal, and said second level of said correction auxiliary circuit is of such a magnitude that said lower trip point exceeds the level of said voltage signal.

21. An electronically controlled fuel injection apparatus for an internal combustion engine according to claim 19, wherein said first level of said correction circuit is of such a magnitude that said upper trip point exceeds the level of said voltage signal, and said second level of said correction auxiliary circuit is of such a magnitude that said lower trip point exceeds the level of said voltage signal.

22. An electronically controlled fuel injection apparatus for an internal combustion engine which controls the amount of fuel supplied to said internal combustion engine by controlling an injection, comprising:

an engine rotational speed sensor for detecting a rotational speed of said engine to produce an engine rotational speed signal;

an intake air amount sensor for detecting the amount of air supplied to said engine to produce an intake air amount signal;

a throttle switch for producing a first high level signal when an open degree of a throttle valve is minimum, producing a second high level signal when the open degree of the throttle valve is maximum and producing a low level signal when the open degree of the throttle valve is between minimum and maximum;

an air conditioner compressor switch for producing a high level signal when an air conditioner is activated and producing a low level signal when said air conditioner compressor is not activated;

a temperature sensor for detecting a temperature of coolant of said engine to produce a coolant temperature signal;

a frequency devider for frequency-dividing said engine rotational speed signal to produce a divide signal;

a converter for converting a frequency of said signal to a voltage to produce a voltage signal;

a comparator having a hysteresis characteristic imparted by a resistor connected between a positive input terminal thereof and an output terminal thereof, for producing a high level signal when said voltage signal from said converter is applied to said positive input terminal and a reference voltage is applied to a negative input terminal and a level of said voltage signal crosses an upper trip point of said hysteresis characteristic upwardly, producing a low level signal when the level of said voltage signal crosses a lower trip point of said hysteresis characterstic downwardly, and producing either the low level signal or the high level signal when the level of said voltage signal is between said upper trip point and said lower trip point;

a correction circuit for raising said reference voltage such that said upper trip point exceeds the level of said voltage signal from said converter when the high level signal is applied thereto from said air conditioner compressor switch, or the level of said coolant temperature signal is below a predetermined level;

a correction auxiliary circuit for raising said reference voltage such that said lower trip point exceeds the level of said voltage signal from said converter when said high level signal is applied thereto from said air conditioner compressor switch and said low level signal is applied thereto from said throttle switch;

a NAND gate having one input terminal thereof connected to said output terminal of said comparator and the other input terminal thereof connected to said throttle switch so that said first high level signal is supplied thereto from said throttle switch;

a divider for dividing the level of said intake air amount signal by the level of said divide signal from said frequency divider and multiplying by a predetermined factor to produce a basic fuel injection signal;

an AND gate having one input terminal thereof connected to the output terminal of said divider and the other input terminal thereof connected to the output terminal of said NAND gate;

an air-fuel ratio sensor for detecting a concentration of residual oxygen in exhaust gas to produce an air-fuel ratio signal; and a multiplier for correcting said basic fuel injection signal based on said second highly level signal from said throttle switch, said coolant temperature signal and said air-fuel ratio signal to control said injector.

* * * * *